United States Patent [19]

Schillinger

[11] 4,212,391

[45] * Jul. 15, 1980

[54] GLASSWARE CARRIER

[75] Inventor: Joseph F. Schillinger, Morrison, Ill.

[73] Assignee: Champion International Corporation, Stamford, Conn.

[ * ] Notice: The portion of the term of this patent subsequent to May 22, 1996, has been disclaimed.

[21] Appl. No.: 3,482

[22] Filed: Jan. 15, 1979

Related U.S. Application Data

[63] Continuation of Ser. No. 898,295, Apr. 20, 1978, Pat. No. 4,155,450.

[51] Int. Cl.[2] ..... B65D 5/04; B65D 85/62

[52] U.S. Cl. ..... 206/434; 229/40; 206/426

[58] Field of Search ..... 206/45.14, 45.19, 193–194, 206/197, 199, 424, 426–427, 433–434, 562–563, 588–590; 229/34 HW, 40

[56] References Cited

U.S. PATENT DOCUMENTS

| | | | |
|---|---|---|---|
| 3,516,593 | 6/1970 | Larsen | 206/424 X |
| 3,931,888 | 1/1976 | Fogel | 206/434 |
| 4,037,721 | 7/1977 | Schillinger | 206/434 |
| 4,130,202 | 12/1978 | Champlin et al. | 229/40 |

*Primary Examiner*—Herbert F. Ross
*Attorney, Agent, or Firm*—Evelyn M. Sommer

[57] ABSTRACT

A receptacle for carrying and displaying glassware formed from a blank comprising a single sheet of paper stock. The receptacle includes an open front and rear rectangular parallelopiped sleeve having a top, a bottom, and opposite side walls connecting the top and bottom wall, all of which are hinged to each other. Four cylindrical glassware items can be supported within the receptacle and displayed between a two part divider wall provided along the interior of the bottom and top wall and the other edges of the receptacle. One part of the divider wall is attached through a connecting panel to the interior of the top wall while the other part of the divider wall is attached through a connecting panel to the interior of the bottom wall. The divider wall is self-sustaining when erected to a generally vertical position but can be pivotally moved to a substantially horizontal position within the interior of the receptacle so as to enable the receptacle sides, top, and bottom, to pivot relative to each other to be collapsed and assume a substantially flat state for transportation and storage. Movement of the divider walls from a vertical position to a horizontal position is achieved by pivoting their respective connecting panels from a first horizontal position to a second horizontal position.

13 Claims, 11 Drawing Figures

Fig. 1.
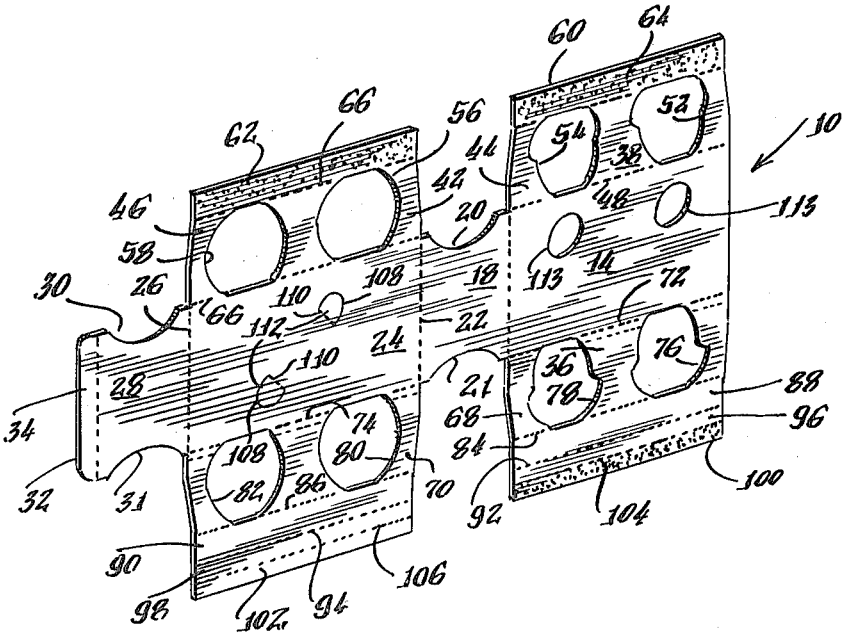
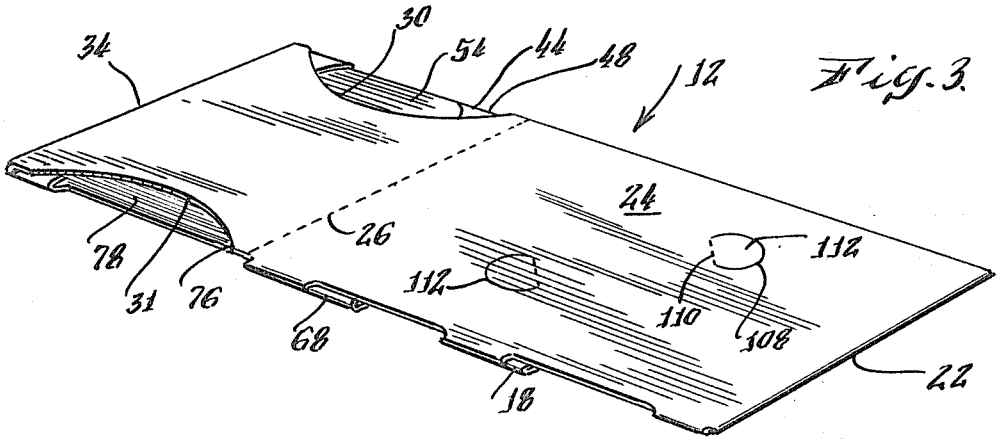
Fig. 3.
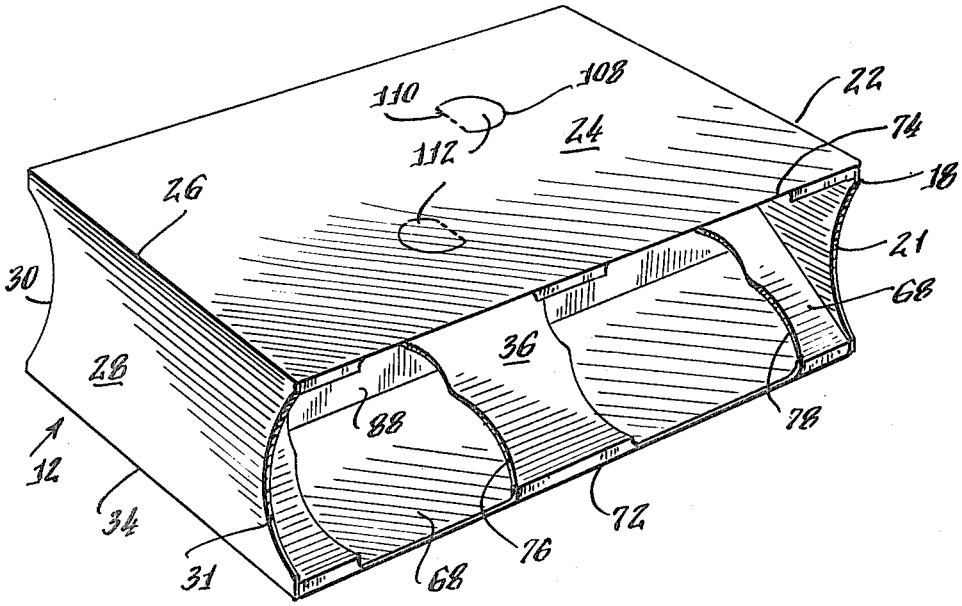
Fig. 2.

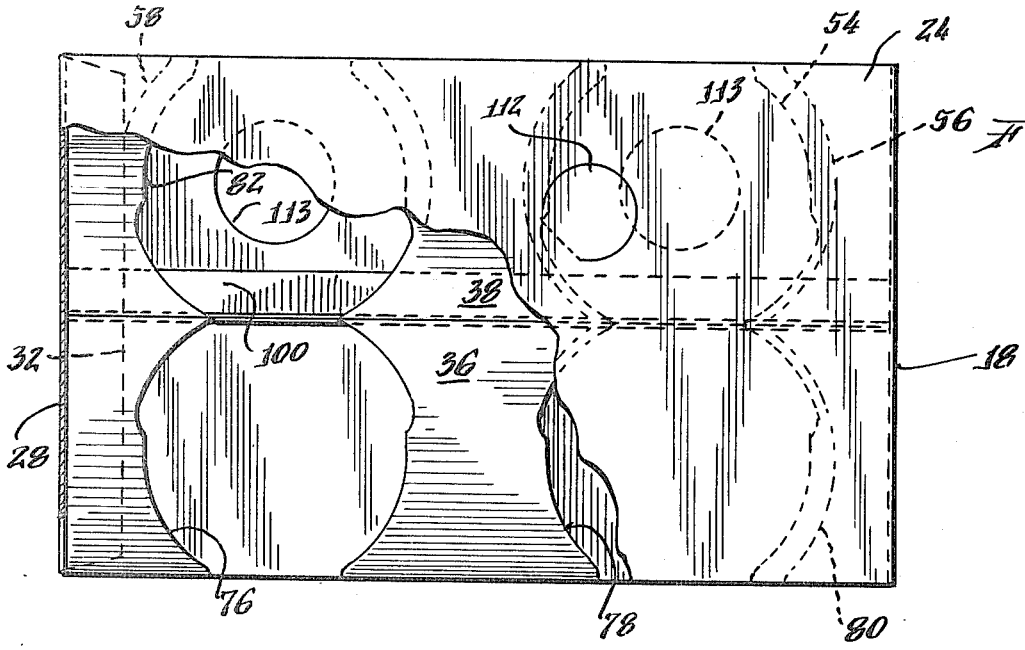
Fig. 8.
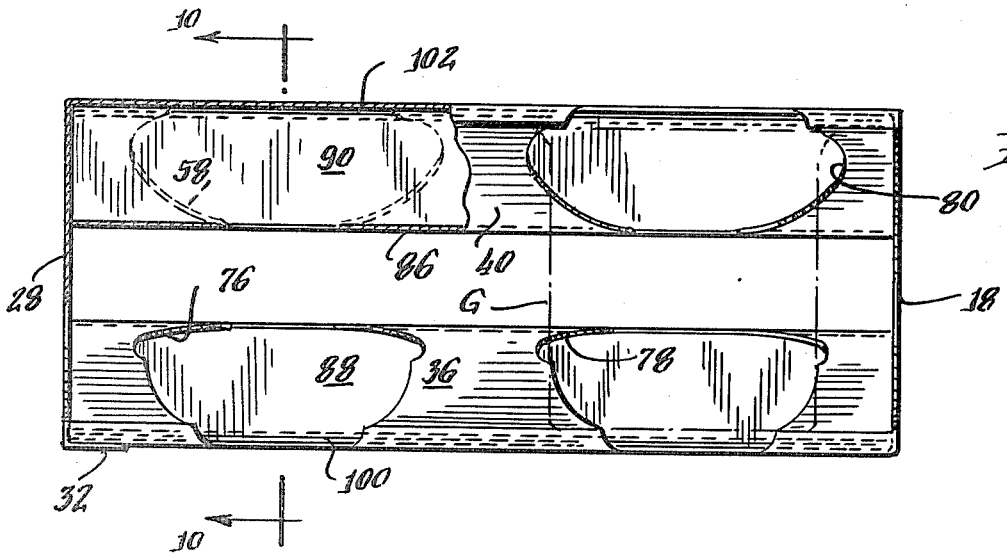
Fig. 9.
Fig. 10.
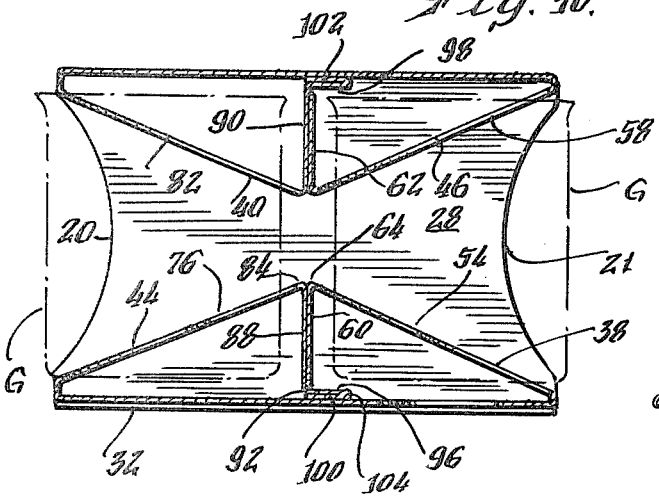
Fig. 11.
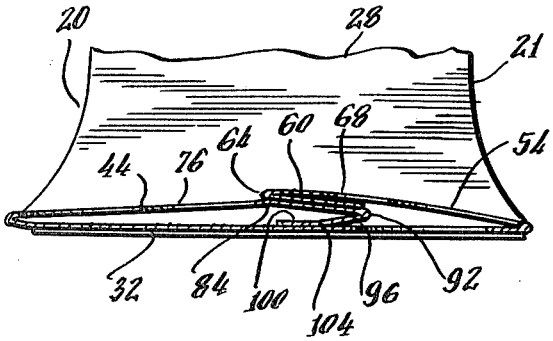

GLASSWARE CARRIER

CROSS-REFERENCES TO RELATED APPLICATIONS

This application is a continuation of U.S. Ser. No. 898,295, filed Apr. 20, 1978, now U.S. Pat. No. 4,155,450, issued May 22, 1979.

BACKGROUND OF THE INVENTION

1. Field of the Invention

This invention relates to a special receptacle, and more particularly, a receptacle designed for displaying glassware, such as generally cylindrical tumblers, in a retail establishment and for transporting the tumblers from one location to another in a safe and secure manner.

2. Description of the Prior Art

Receptacles for carrying objects such as tumblers or the like in which the objects being carried can be viewed are known in the art.

In U.S. Pat. No. 3,598,302 there is described a carrier for objects of this type which comprises an open ended sleeve designed to hold the product in position so that it can be displayed. The product is held in place by locking panels hinged to the top and bottom edges of the sleeve and folded inwardly toward the center of the sleeve. These locking panels are provided with elliptical openings therein to snuggly fit about the wall of the generally cylindrical objects. This provides a means of engaging the opposite ends of the objects to hold them contained within the sleeve. The locking panels are held in place by a central strut which engages the inclined panels, and holds them from unfolding. Once assembled, however, the sleeve can not be knocked-down or collapsed for storage, shipment, or reuse, thereby requiring assembly directly from a blank at the point of use, which is extremely inconvenient.

Of almost identical construction is the carrier disclosed in U.S. Pat. No. 3,854,580, except additional locking tabs are formed in the top panel of the sleeve for holding the walls of the glassware against movement in the carrier. These tabs contact the interior wall of each glass supported by the carrier.

U.S. Pat. No. 3,931,888, relates to a carrier of the same general type, but is provided with pressure applying panels to rigidify the retained glassware. As with U.S. Pat. Nos. 3,598,302 and 3,854,580, the carrier, once assembled, cannot be collapsed to a substantially flat state.

In U.S. Pat. No. 4,037,721, there is disclosed a receptacle for displaying and transporting glassware, such as generally cylindrical tumblers, which is comprised of an open front and rear rectangular parrallelopiped sleeve having a top wall, a bottom wall and opposite side walls all hinged to each other and a center wall along the interior of the top wall and the bottom wall. The center wall is collapsible within the interior of the receptacle after assembly so as to enable the receptacle to assume a substantially flat state for transportation, storage or reuse. The center wall is maintained in a locked, upright position by means of tabs integrally formed on a panel comprising a first portion of the center wall which engage correspondingly located slots in a panel comprising a second portion of the center wall. The center wall is collapsed by removing the tabs from their respective slots and then pivoting the center wall about certain fold lines.

SUMMARY OF THE INVENTION

In accordance with the present invention, the special receptacle is formed from a single planar blank for ease of assembly. The resultant receptacle includes an open front and rear rectangular parallelopiped sleeve having a top, bottom, and opposite side walls connecting the top and bottom wall, all of which are hinged to each other so that the receptacle can be collapsed and stored in a substantially flat position until used. Four cylindrical glassware items can be supported within the receptacle and displayed between a divider wall provided along the interior of each of the bottom and top wall respectively of the receptacle. These divider walls can be pivoted within the interior of the receptacle after assembly of the blank from an upright self sustaining position to a horizontal position so as to enable the receptacle sides, top, and bottom, to pivot relative to each other and assume a substantially flat state for transportation and storage until needed to support a plurality of cylindrical glassware items between the top and bottom center walls.

To erect the receptacle in a stable and noncollapsible state, the divider walls are pivoted about connecting panels from a generally horizontal position relative to the top and bottom walls respectively to a substantially upright condition. When the divider walls are in a generally upright position they are essentially locked in place and require no additional means, such as tabs to maintain them in that position.

The connecting panels attached to the divider walls are hingedly connected to the top and bottom walls, respectively, of the receptacle.

Connected to the bottom and top walls of the receptacle are panels each containing two openings on either side of the central wall. When the divider walls are pivoted to their upright position, the openings in the bottom and top panels are aligned and are slanted in opposite directions. The openings of the panels connected to the top walls are elliptically shaped. The openings of the panels connected to the bottom walls are also substantially elliptically shaped; however a part of each one of the ellipse is somewhat reduced in size so as to provide an overall shape that minimizes the movement of the item inserted in the opening. A pair of the openings in the top and bottom panels receive a glassware item therebetween in contact with the sides of the openings to lock the glassware item firmly in the receptacle, which also rigidifies the receptacle.

A pair of hinged tabs are provided in the top wall which when bent downwardly provide finger openings for carrying the receptacle and its contents and a pair of openings are provided in the bottom wall to permit viewing the glassware being held in the receptacle from the bottom.

To collapse the receptacle, the divider walls are pivoted about their respective connecting panels to a substantially horizontal position.

BRIEF DESCRIPTION OF THE DRAWINGS

Further objects and advantages of the invention will become apparent from the following description and claims and from the accompanying drawings, wherein:

FIG. 1 is a front perspective view of a blank for forming the glassware receptacle of the present invention;

FIG. 2 is a perspective view of the glassware receptacle of the invention formed from the blank of FIG. 1;

FIG. 3 is a perspective view of the glassware receptacle of FIG. 2 collapsed for storage and transportation after it has been assembled from the blank of FIG. 1;

FIG. 8 is a top plan view, partly in section, of the assembled receptacle;

FIG. 9 is a front view in elevation, partly in section, of the receptacle of FIG. 8; and FIG. 10 is a cross-sectional view taken substantially along the plane indicated by line 10—10 of FIG. 9.

FIG. 11 is a partial cross-sectional view showing the divider wall in a substantially horizontal position.

DETAILED DESCRIPTION OF THE PREFERRED EMBODIMENT

Figure 4:
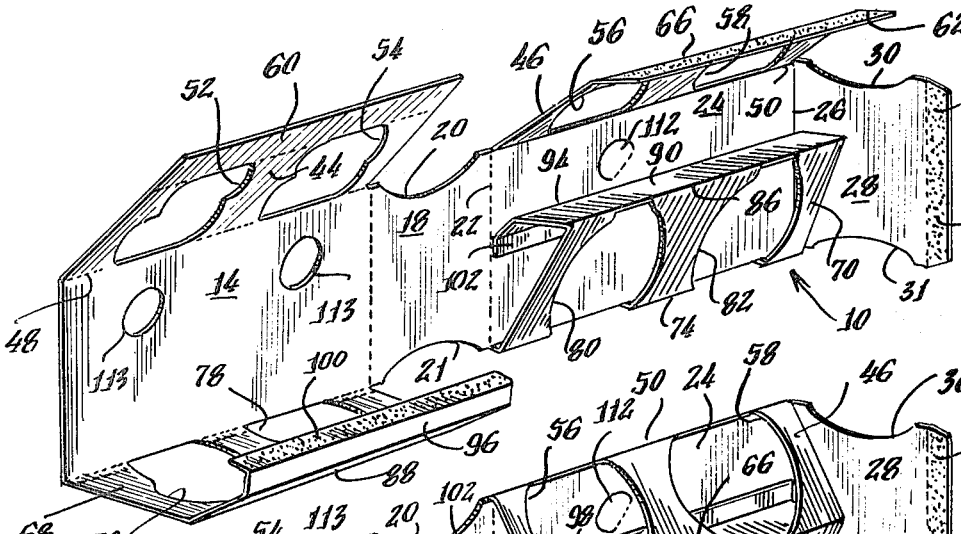
FIGS. 4 to 7, inclusive, are perspective views of the various stages of assembly of the blank of FIG. 1 to form the receptacle of FIG. 2.

Referring now to the drawings in detail, wherein like numerals indicate like elements throughout the several views, the blank 10 used to form the receptacle 12 of the present invention includes a substantially planar sheet of material, such as cardboard, having a substantially rectangular panel 14 connected by a score line 16 to a second panel 18 having arcuate edges 20 and 21. This pattern is repeated once more in that panel 18 is connected by score line 22 to a second rectangular panel 24 connected by a score line 26 to a second panel 28 having arcuate edges 30 and 31. In addition, second panel 28 has a flap or extension 32 connected by a score line 34 to one end of panel 28.

Rectangular panel 14 includes lateral extensions 36 and 38 and rectangular panel 24 includes lateral extensions 40 and 42. Each of the extended panels 38 and 42 includes a first portion 44 and 46 respectively, connected by score lines 48 and 50 to panels 14 and 24 respectively, and is provided with a pair of openings cut therein and disposed in side-by-side relationship. The openings 52 and 54 in portion 44 are in the shape of two partial ellipses of different sizes while the openings 56 and 58 in portion 46 are in the shape of a single partial ellipse. Second portions 60 and 62 which are generally rectangular in shape are connected by score lines 64 and 66 respectively to portions 44 and 46, respectively.

Each lateral extension panel 36 and 40 includes a first portion 68 and 70, respectively, bendable with respect to rectangular panel 14 and 24, respectively, about score lines 72 and 74, respectively. A pair of openings 76 and 78 similar in shape to openings 52 and 54 are cut in first portion 68 of extension panel 36 and disposed in side-by-side relationship and a pair of openings 80 and 82 similar to shape to openings 56 and 58 are cut in first portion 70 of panel 40 and similarly positioned. Each of the openings 52, 54, 56, and 58 is aligned, respectively, with one of the openings 76, 78, 80 and 82. First portions 68 and 70 of panels 36 and 40 are connected by score lines 84 and 86 respectively to second rectangular portions 88 and 90 respectively. Second portions 88 and 90 are connected by score lines 92 and 94 respectively to third rectangular portions 96 and 98, respectively, and fourth portions 100 and 102 are connected to third portions 96 and 98, respectively, by fold lines 104 and 106, respectively.

The blank construction is completed by cutting a pair of substantially semi-circular lines 108 in rectangular panel 24, each of which will bend about a score line 110, and a pair of circular openings 112 and 113 in rectangular panel 14.

Figure 5:
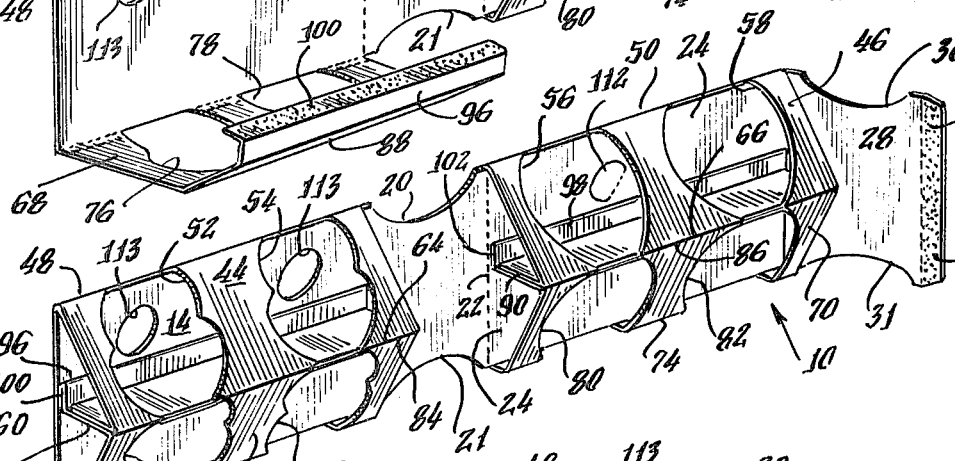
Figure 6:
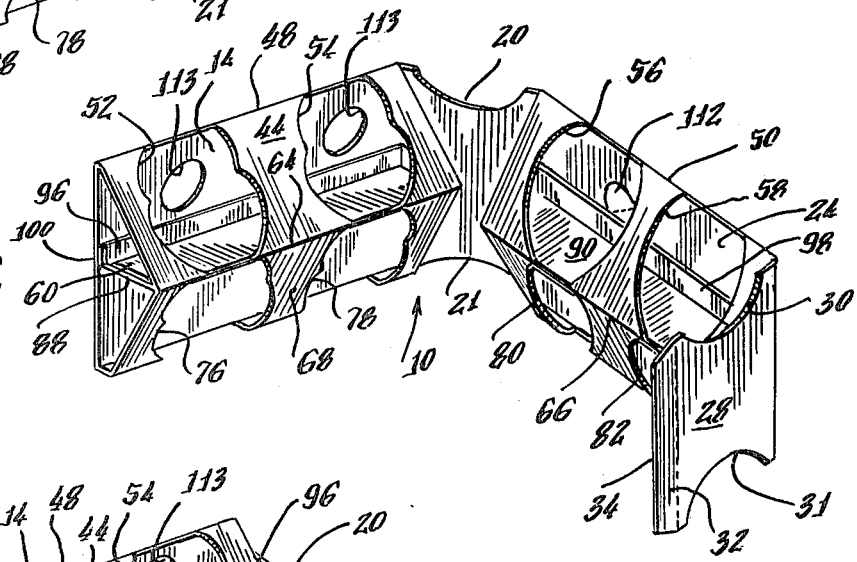
Figure 7:
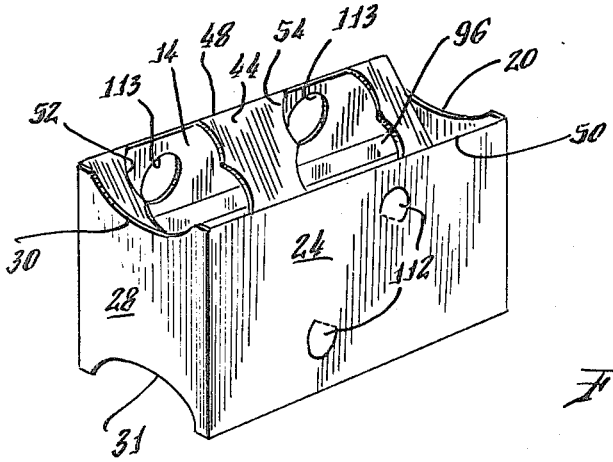

In order to assemble the receptacle 12, as shown in FIGS. 4 to 7, inclusive, the panels 14, 18, 24 and 28 are bent at score lines 16, 22 and 26 respectively, to form a substantially rectangular parallelopiped sleeve having an open front and back. To retain the panels in such a configuration, tab 32 hingedly connected to panel 28 by score line 34 is bent relative to panel 28 and adhesively secured to the outer surface of panel 14. Panel 14 thus forms the bottom of the receptacle 12, while rectangular panel 24 constitutes the top. Panels 18 and 28 from the sides. Lateral extensions 36, 38, 40 and 42 are bent above score lines 72, 48, 74 and 50 respectively, of each panel 14 and 24 to be disposed within the interior of the receptacle through the open front and back areas. Fourth portions 100 and 102 of each of the extensions 36 and 40 are adhesively connected to approximately the middle of each of the rectangular panels 14 and 24. This is accomplished by bending extensions 36 and 40 about score lines 84, 86, 92, 94, 104 and 106 to dispose the extensions within the interior of the receptacle 12.

In a like manner, extension 38 and 42 are bent about score lines 64 and 66 respectively and second portions 60 and 62 are adhesively connected to the rear surfaces of second rectangular portions 88 and 90 respectively of panels 36 and 40 respectively. As can be appreciated, portions 96 and 98 constitute the connecting panels that can be pivotally moved from a first horizontal position to a second horizontal position, portions 60 and 88 which are secured together constitute the lower divider wall and portions 62 and 90 which are secured together constitute the upper divider wall.

In this configuration, receptacle 12 can be collapsed to a substantially flat condition as shown in FIG. 3 for transportation, storage and reuse. To assemble the carrier for use in receiving and displaying a cylindrical glassware item or to carry it, it is only necessary that third portion 96 and 98 of each lateral extension 36 and 40 be pivoted from the horizontal position shown in FIG. 11 to a second horizontal position as shown in FIG. 10. When in that position, portions 60 and 88 which are adhesively secured together and portions 62 and 90 which are adhesively secured together and which constitute the upper and lower divider walls, respectively, will be in an upright and self-locked position.

To disassemble the carrier, third portions 96 and 98 are pivoted back to the first horizontal position which enables the carrier to collapse to a flattened state as shown in FIG. 11.

When receptacle 12 is so assembled, openings 52, 54, 56 and 58 will be vertically aligned with openings 76, 78, 80 and 82, respectively. In addition, openings 112 and 113 will be aligned with openings 54 and 52 respectively. The openings 52, 54, 56 and 58 in first portions 44 and 46, respectively, of lateral extensions 38 and 42, respectively, which are aligned, slope rearwardly towards each other from the front to the back of the receptacle 12, as the first portions 36, 38, 40 and 52 are disposed at an acute angle with respect to the top and bottom rectangular panels 24 and 14. The openings, being elliptical, assume a circular projection in plan. Accordingly, a cylindrical glassware item G can be disposed within a pair of the aligned openings 52 and 76 and will contact and be retained by the sides of the openings, while further stabilizing the receptacle 12. Due to the open front and back surfaces of receptacle 12, along with the arcuate sides of the side walls 18 and 28, the glassware will be clearly visible for display purposes.

In order to carry the receptacle 12, it is only necessary to depress tabs 112 formed in the top rectangular panel 24 by the semi-circular score lines 108. The tabs are depressed about score lines 110 to provide convenient finger-receiving openings to carry the glassware receptacle 12 and glassware G.

If desired, the receptacle 12 can be collapsed for convenient storage and future reuse by pivoting third portions 96 and 98 as shown in FIG. 11 causing the divider walls to assume the position as shown therein. The top and bottom panels 24 and 14, as well as the side panels 18 and 28, can then be pivoted about score lines 16, 22, 26 and 34 to a substantially flat condition.

What is claimed as new is:

1. In a receptacle for displaying and carrying glassware comprising a substantially rectangular parallelopiped sleeve having a top wall, a bottom wall, a pair of side walls, and an open front and rear surface, said sleeve being collapsible to a substantially flat configuration about hinge lines connecting said walls at their lateral edges, a substantially upright divider wall secured to the interior of each of said top and bottom walls and extending between said pair of side walls, and a support panel secured between said bottom wall and the divider wall on each side of said divider wall and said top wall and the divider wall on each side of said divider wall, each of said support panels being disposed at an acute angle with respect to the top and bottom walls to which it is secured and having at least one opening for receiving an item of glassware disposed between the openings adjacent said top and bottom walls on the same side of each of said divider walls, the improvement comprising:

(a) a divider wall locking means for each said divider wall comprising:

i. a movable panel hingedly connected between said divider wall and said adjacent top or bottom walls and capable of being moved from a first horizontal position locking said divider wall upright relative to an adjacent top or bottom wall and a second horizontal position thereby unlocking and collapsing said divider wall thereto, said movable panel including a first and second panel portion pivotably connected along a common fold line to form a hinge, said first panel portion being pivotably connected to said divider wall and said second panel portion being connected to said adjacent top or bottom wall, whereby said first and second panel can be placed in face to face relation to define said first horizontal position and substantial side by side relation to define said second horizontal position.

2. The receptacle of claim 19 and further including an attachment panel hingedly secured to one of said support panels.

3. The receptacle of claim 2 wherein said second panel portion is adhesively secured along one of its surfaces to its adjacent top or bottom wall.

4. The receptacle of claim 3 wherein said attachment panel is secured to said divider wall.

5. The receptacle of claim 4 and wherein the other support panel is hingedly connected to said divider wall.

6. The receptacle of claim 5 including tab means on said top wall pivotable about a score line to form a finger-receiving opening for carrying said receptacle.

7. The receptacle of claim 6 wherein the bottom wall includes at least one opening positioned to permit viewing the glassware held in the receptacle.

8. The receptacle of claim 7 and wherein each one of the openings in the support panels connected to the top wall is in the shape of a portion of an ellipse.

9. The receptacle of claim 8 and wherein each one of the openings in the support panels connected to the bottom wall is in the shape of portions of two ellipses of different sizes.

10. In a receptacle blank formed from paperboard stock comprising a first and second center rectangular panel connected by spaced vertical score lines to a third substantially rectangular panel having free arcuate edges, and a fourth substantially rectangular panel having free arcuate edges connected by a vertical score line to said first center rectangular panel, each of said first and second center rectangular panels including upper and lower extension panels connected by spaced horizontal score lines to opposed edges, respectively, of said center panels, each of said extension panels having a pair of side-by side openings cut therein, the improvement comprising:

each of said upper extension panels including an upper imperforate substantially rectangular portion foldable about a substantially horizontal score line, and each of said lower extension panels including an imperforate substantially rectangular portion foldable about three, spaced, substantially horizontal score lines.

11. The blank of claim 10 wherein at least a portion of each of said upper and lower imperforate portions has an adhesive layer.

12. The blank of claim 10 wherein said openings are at least partially elliptical in plan.

13. The blank of claim 12 wherein at least some of said openings are in the shape of two partial ellipses of different sizes when viewed in plan.

* * * * *